US005205752A

United States Patent [19]

Taguchi et al.

[11] Patent Number: 5,205,752

[45] Date of Patent: Apr. 27, 1993

[54] LOW INSERTION/WITHDRAWAL-FORCE CONNECTOR

[75] Inventors: Naoto Taguchi; Yuji Hatagishi; Katsuhiko Onoda, all of Shizuoka, Japan

[73] Assignee: Yazaki Corporation, Tokyo, Japan

[21] Appl. No.: 841,794

[22] Filed: Feb. 26, 1992

[30] Foreign Application Priority Data

Feb. 28, 1991 [JP] Japan ..... 3-16468[U]

[51] Int. Cl.[5] ..... H01R 13/00

[52] U.S. Cl. ..... 439/157

[58] Field of Search ..... 439/152-160

[56] References Cited

U.S. PATENT DOCUMENTS 4,875,873 10/1989 Ishizuka et al. ..... 439/157

5,115,376 5/1992 Nakajima ..... 439/157

FOREIGN PATENT DOCUMENTS 1-88474 6/1989 Japan .

1-88475 6/1989 Japan .

*Primary Examiner*—Joseph H. McGlynn

*Attorney, Agent, or Firm*—Sughrue, Mion, Zinn, Macpeak & Seas

[57] ABSTRACT

According to the present invention, cam grooves are formed in a lower surface of a rotation plate of a cam member, and are disposed symmetrically with respect to a rotation shaft. A rotation retaining plate is mounted on a distal end of the rotation shaft. A pair of housing have cam follower pins, respectively, which are engaged in the cam grooves, respectively. One housing has a pin guide groove which guides the rotation shaft and the cam follower pin. A flexible lock member having a lock release projection is provided at an introduction groove of one cam groove in the rotation plate. Upon the initial fitting of the pair of housings, the cam follower pin is engaged with the lock release projection to release the locking of the rotation plate by the flexible lock member, thereby allowing the angular movement of the cam member.

12 Claims, 11 Drawing Sheets

LOW INSERTION/WITHDRAWAL-FORCE CONNECTOR

BACKGROUND OF THE INVENTION

This invention relates to an improved low insertion/-withdrawal-force connector in which female and male housings can be fitted together and disengaged from each other by a cam member with a small force.

A connector of this type as shown in FIGS. 14 and 15 is proposed in Japanese Utility Model Application (OPI) No. Hei. 1-88474 (the term "OPI" as used herein means an "Unexamined Published Application") In this connector, a rotation shaft $a_2$ is formed on a hood $a_1$ of a female housing a, and a cam follower $b_1$ is formed on a male housing b. An operating member c has a hole $c_2$ serving as an axis of rotation of a rotation plate $c_1$, and a cam groove $c_3$. Using a rotation moment of the member c, the insertion and withdrawal of the male housing b relative to the female housing a can be done easily with a smaller force.

As is clear from FIG. 15, when the operating member c is fully rotated, so that the cam follower $b_1$ reaches an end $c_{31}$ of the cam groove $c_3$, the fitting connection between the female and male housings a and b is completed. However, the operating member c is of such a construction that it can be easily removed at any point during the time from the start to the end of the fitting operation. Therefore, there is a possibility that the operating member c may be inadvertently removed when the female and male housings a and b are still in an incompletely-fitted condition. Moreover, it is difficult to judge at a glance whether or not the fitting is complete. Furthermore, each time the fitting operation is finished, the operating member c is removed, and this increases the number of operation steps when a number of connectors are to undergo the fitting operation. Therefore, the assembling time and the labor cost are increased.

SUMMARY OF THE INVENTION

The present invention has been made in view of the above problems, and an object of the invention is to provide a low insertion/withdrawal-force connector in which a cam member will never be disengaged during a fitting operation of female and male housings, and the cam member does not need to be removed when the housings are completely fitted together, and whether or not the fitting condition is good can be judged at a glance, and the complete fitting is ensured, and a compact construction can be achieved.

To achieve the above object, according to the first aspect of the invention, a low insertion/withdrawal-force connector comprises:

a cam member including cam grooves which are continuous respectively with introduction grooves, are provided at a lower surface of a rotation plate, and are disposed symmetrically with respect to a rotation shaft, and a rotation retaining plate provided at a distal end of the rotation shaft;

a pair of housings which are fitted together and disengaged from each other by angularly moving the cam member, the two housings having cam follower pins, respectively, which are engaged in the two cam grooves of the cam member, respectively, one of the pair of housings having a pin guide groove which guides the cam follower pin of the other housing and the rotation shaft of the cam member, wherein when the cam member is angularly moved in an initial fitting condition of the pair of housings in which the cam follower pins of the housings are engaged respectively in the pair of cam grooves, the cam member moves toward an inner end of the pin guide groove, and also the pair of housings are moved toward each other toward the rotation shaft of the cam member; and a flexible lock member having a lock release projection is provided in the introduction groove of one of the cam grooves in the rotation plate, wherein the cam follower pin of the other housing is engaged with the lock release projection to release the engagement between the flexible lock member and the one housing at the time of the initial fitting of the pair of housings, thereby allowing the angular movement of the cam member.

According to the second aspect of the present invention, an angular movement-effecting thumbpiece is withdrawably or slidably mounted on an upper surface of the rotation plate, and lock member is provided between the one housing and the thumbpiece so as to lock the thumbpiece when the pair of housings are completely fitted together.

In either of the low insertion/withdrawal-force connectors according to the first and second aspects of the present invention, when the cam member is angularly moved after the cam follower pins are received respectively in the cam grooves, the pair of housings are moved each other toward the rotation shaft, and therefore the operation can be carried out smoothly. At this time, the rotation shaft moves along the pin guide groove. In the first aspect of the invention, the rotation plate constituting the cam member has the flexible lock member, and unless the engagement of the flexible lock member is released by the initial fitting relative to the mating housing, the cam member can not be angularly moved, and also unless the complete fitting is achieved, the cam member can not be locked. Similarly, in the second aspect of the invention, there is provided the angular movement-effecting thumbpiece which is withdrawably or slidably mounted on the rotation plate constituting the cam member, and this thumbpiece can not be locked unless the complete fitting is achieved.

Namely, during the fitting operation of the female and male housings, the cam member can not be removed, and also the thumbpiece can not be locked. Therefore, the complete fitting is promoted, and an incomplete fitting is prevented. Further, there is no need to remove the cam member when the fitting is completed, and the number of the operation steps is reduced, and whether the cam member exists or not can be judged at a glance at an inspection step or the like, and whether the fitting condition of the connector is good or not can be judged easily and properly.

DETAILED DESCRIPTION OF THE PREFERRED EMBODIMENTS

Figure 1:
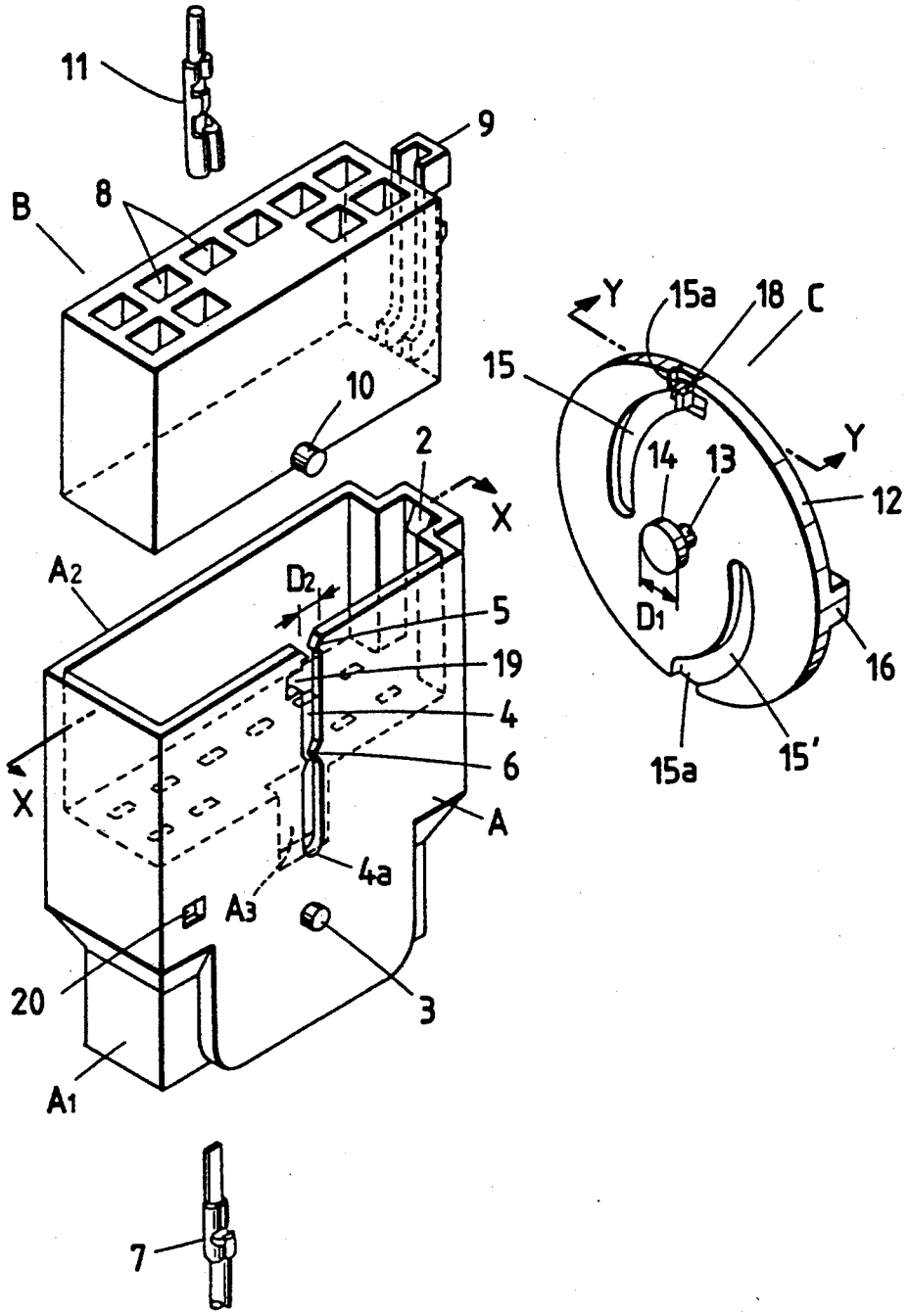
FIG. 1 is a perspective view of a first embodiment of the invention, showing female and male housings and a cam plate as being separate from one another.
Figure 2:
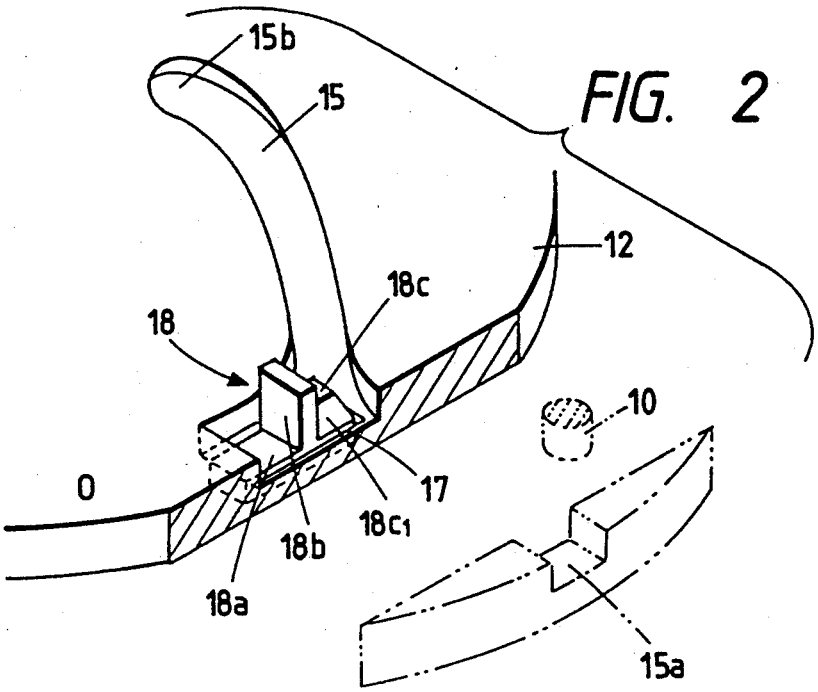
FIG. 2 is an enlarged perspective view of a rotation plate cut through the line Y—Y.

In FIGS. 1 to 4, reference character A denotes a female housing of a synthetic resin, reference character B a male housing, and reference character C a cam member for fitting and disengaging the two housings relative to each other. Male terminals 7 and female terminals 11 are received respectively in terminal receiving chambers 1 and 8 of the pair of female and male housings A and B constituting a connector.

The female housing A includes a housing body $A_1$ having a plurality of terminal receiving chambers 1, and a hood $A_2$ formed forwardly of this housing body so as to receive the male housing B. A retaining portion 2, serving as a lock means for the male housing B, is formed on one end wall of the hood $A_2$. A cam follower pin 3 is formed on one of opposed longitudinal side walls of the female housing A at a lower central portion thereof, and a pin guide groove 4 is formed through this side wall, and is disposed above the pin 3.

The pin guide groove 4 is open to the end edge of the hood $A_2$, and extends in the direction of fitting of the male housing B. An end 4*a* of this pin guide groove reaches a recess $A_3$ in the housing body A. Provisionally-retaining projections 5 for the male housing B are provided at the inlet of the groove 4, and provisionally-retaining projections 6 are provided at the intermediate portion of this groove.

Formed on one of right and left end walls of the male housing B is a flexible lock arm 9 for engagement with the retaining portion 2 of the female housing A. A cam follower pin 10 corresponding to the cam follower pin 3 is formed on one of opposed side walls of the male housing at a lower portion thereof (the fitting side).

The cam member C comprises a circular rotation plate 12, and an angular movement-effecting thumbpiece 16 which is formed on an outer surface of the rotation plate and extends transversely through the center thereof. A rotation shaft 13 is formed on the inner surface of the rotation plate 12 at the center thereof, and a rotation retaining plate 14 is formed on the distal end of this rotation shaft. Cam grooves 15 and 15 are formed in the inner surface of the rotation plate 12 symmetrically with respect to the rotation shaft 13, the cam grooves having introduction grooves 15 and 15′ which are disposed at upper and lower portions, respectively, and extend parallel to a diametrical line perpendicularly intersecting the thumbpiece 16.

Each of the cam grooves 15 and 15′ is formed along an oval curved line in such a manner that the distance of the cam groove from the rotation shaft 13 of the rotation plate 12 is continuously varied, and its inner end portion 15*b* is the nearest to the rotation shaft 13 whereas its inlet portion (the introduction groove 15*a*) is the remotest therefrom. The distance between the inner ends 15*b* and 15*b* of the two cam grooves is so determined that this distance is equal to the distance between the cam follower pins 3 and 10 when the female and male housings A and B are completely fitted together. With respect to the size of the rotation retaining plate 14, its diameter $D_1$ is sufficiently larger than the width $D_2$ of the pin guide groove 4 so that the rotation retaining plate will not become disengaged from the pin guide groove.

An opening 17 is provided at the outer end portion of the introduction groove 15*a* of one cam groove 15 of the rotation plate 12, and a flexible lock member 18 is received in this opening so as to be resiliently displaced therein. The opening 17 perpendicularly intersects the introduction groove 15*a*, and is open in a direction away from the cam groove 15. The flexible lock member 18 includes a flexible tongue 18*a* of the cantilever type which extends toward the introduction groove 15*a* and has a fulcrum O at one end of the opening 17, a lock piece 18*b* projecting downwardly from this flexible tongue, and a lock release projection 18*c* formed on the free end of the tongue 18*a*. The front surface of the projection 18*c* serves as a driven inclined surface $18c_1$ for engagement with the cam follower pin 10. The lock piece 18*b* may be omitted, in which case the lock release projection 18*c* performs its function.

A provisional lock hole 19 and a complete lock hole 20, which are adapted to be engaged with the lock member 18, are provided in the outer peripheral wall of the female housing A. The provisional lock hole 19 is provided at the inlet portion of the pin guide groove 4 in communicating relation thereto, and the complete lock hole 20 is provided at a position angularly displaced about 90 degrees from the provisional lock hole 19 about the inner end 4*a* of the pin guide groove 4.

Figure 3:
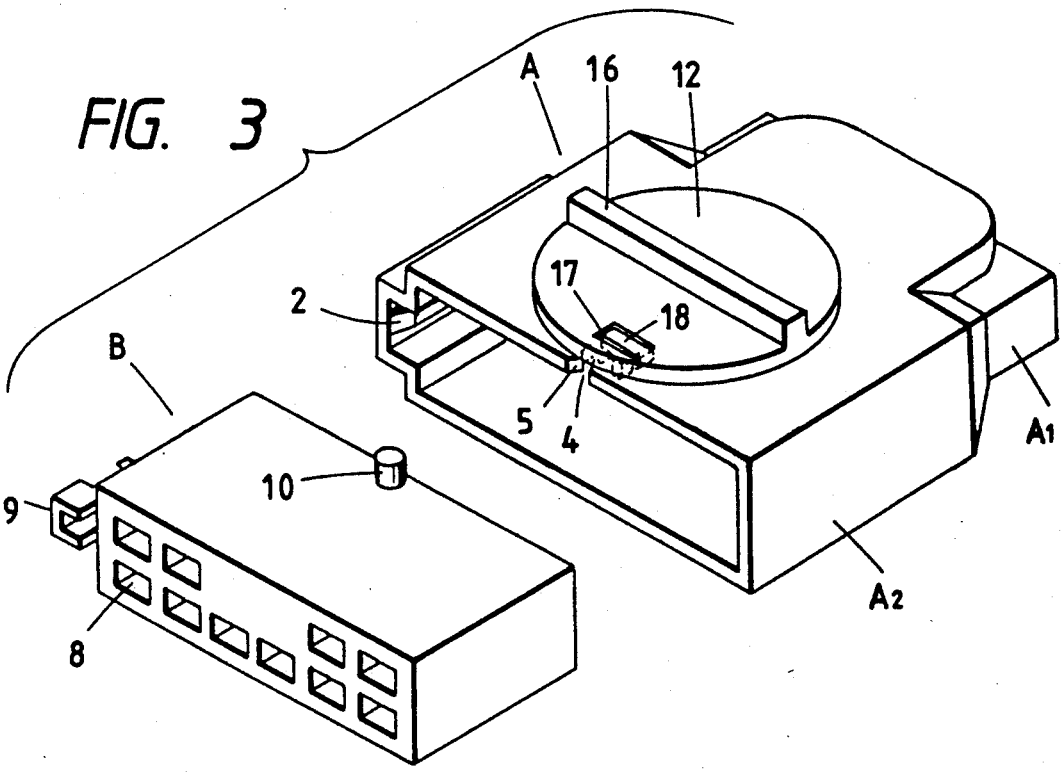
FIG. 3 is a perspective view showing the cam member attached to the female housing of FIG. 1.
Figure 6A:
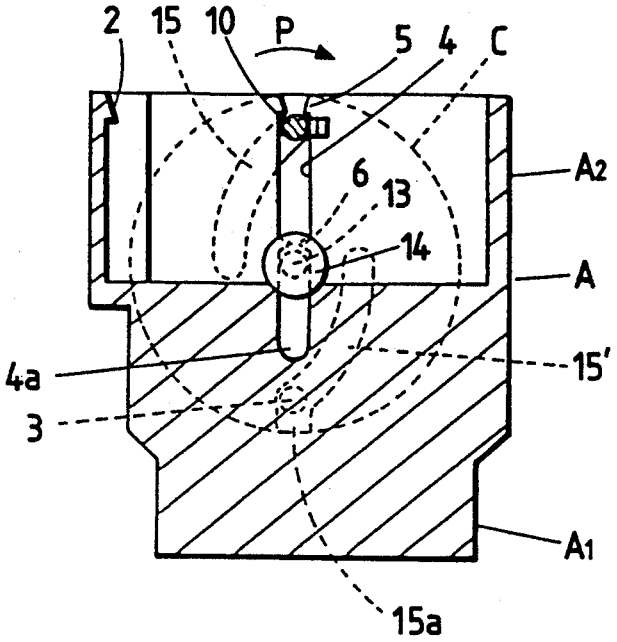
FIGS. 6(A) and 6(B) are cross-sectional views taken along the line X—X of FIG. 1, FIG. 6(A) showing the position of the cam member before the fitting of the female and male housings, and FIG. 6(B) showing the position of the cam member after the fitting.

In the above construction, first, as shown in FIG. 3, the thumbpiece 16 of the cam member C is oriented perpendicularly to the pin guide groove 4 of the female housing A, and in this condition the rotation shaft 13 is inserted into this groove 4, with the flexible lock member 18 disposed outwardly. The rotation shaft 13 passes past the provisionally-retaining projections 5 provided at the inlet portion of the pin guide groove, and is abutted against the provisionally-retaining projections 6 at the intermediate portion of the pin guide groove. Then, the rotation shaft is further pushed strongly to pass past the projections 6, and the cam follower pin 3 is engaged in the introduction groove 15*a* of the lower cam groove 15′, as shown in FIG. 6(A). Therefore, the cam member C is rotatable thanks to the rotation shaft 13 received in the pin guide groove 4, and the rotation retaining plate 14 prevents the rotation shaft from becoming disengaged from the groove 4, and the rotation shaft is retained between the provisionally-retaining projections 6 and the cam follower pin 3.

Figure 4:
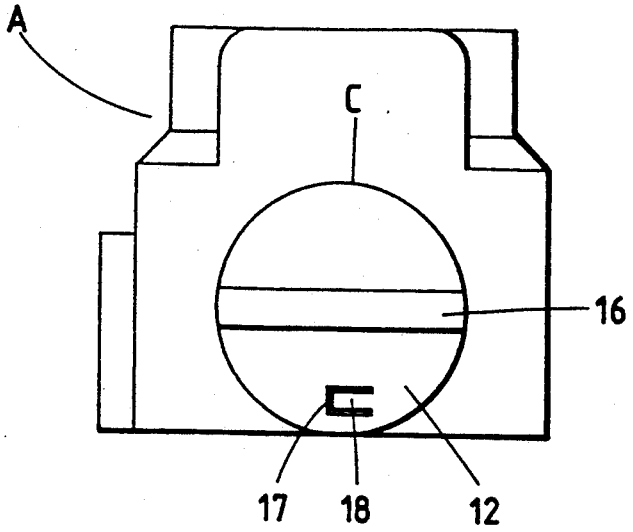
FIG. 4 is a plan view of the female housing of FIG. 1.
Figure 5A:
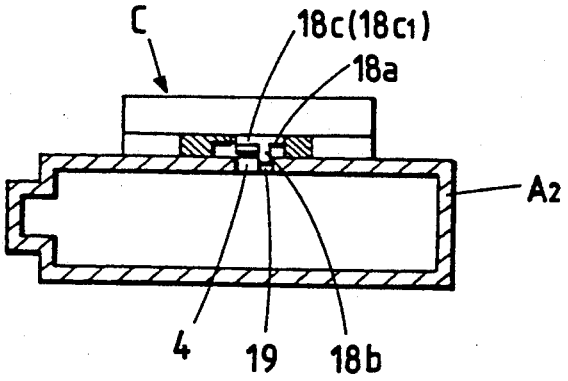
FIGS. 5(A) and 5(B) are cross-sectional views showing the operation of a lock release projection of a flexible lock member in FIG. 1.

FIGS. 3 and 4 show the above condition in which the cam member C is provisionally retained on the female housing A. At this time, since the lock piece **18*b* of the flexible lock member 18 is received in the provisional lock hole 19 continuous with the pin guide groove 4, the rotation plate 12 does not angularly moved in either direction. The lock release projection 18*c* of the flexible lock member 18 is disposed in the pin guide groove 4, and its driven inclined surface 18*c*$_1$ faces forwardly (see FIG. 5**(A)).

FIG. 6(A) shows an initial stage of the fitting condition in which after the male housing B is opposed to the hood $A_2$, the cam follower pin 10 is caused to pass past the provisionally- retaining projections 5 into the inlet of the upper cam groove 15 through the introduction groove **15*a*. In FIG. 6(A), for the sake of simplicity of the drawings, the showing of the male housing B is omitted, and the cam follow pin 10** is shown.

Figure 5B:
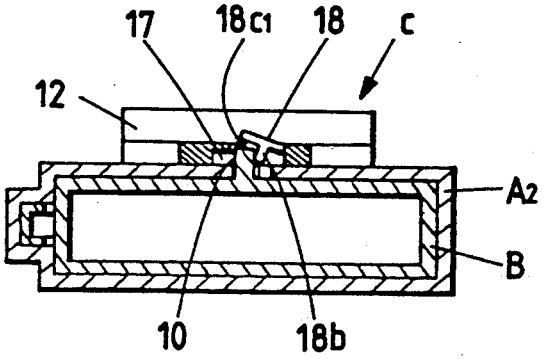

More specifically, when the cam follower pin 10 of the male housing B is inserted into the introduction groove **15*a* against the resistance of the provisionally-retaining projections 5, the follower pin 10 is abutted against the driven inclined surface 18*c*$_1$ of the lock release projection 18*c*, and advances in sliding contact with this surface. As a result, an upward force acts on the flexible lock member 18 (or the lock release projection 18*c*) of the cam member C, so that the member 18 is flexed upward as shown in FIG. 5(B). At the same time, the lock piece 18*b* is fully brought out of the provisional lock hole 19, so that the cam member C becomes angularly movable in the pin guide groove 4**.

Figure 6B:
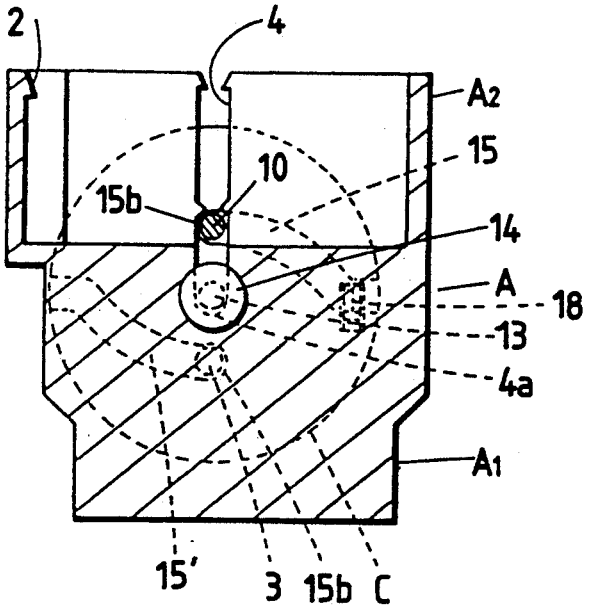

Then, when the cam member C is rotated in a direction of arrow P by the thumbpiece 16, the male housing B and the female housing A are moved toward the rotation shaft 13 through the cam follower pins 10 and 3 engaged respectively in the cam grooves 15 and 15', so that the rotation shaft 13 moves toward the inner end **4*a* of the pin guide groove 4. FIG. 6(B) shows the completely-fitted condition in which after the cam member C is angularly moved about 90 degrees from the initially-fitted position, the female and male housings A and B are completely fitted together, and the rotation retaining plate 14 on the rotation shaft 13 reaches the inner end 4*a*** of the pin guide groove.

Figure 7A:
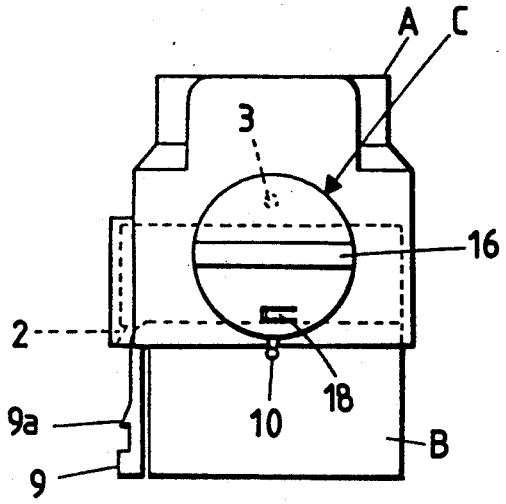
FIGS. 7(A) to 7(C) are plan views showing the process of fitting of the female and male housings.
Figure 7B:
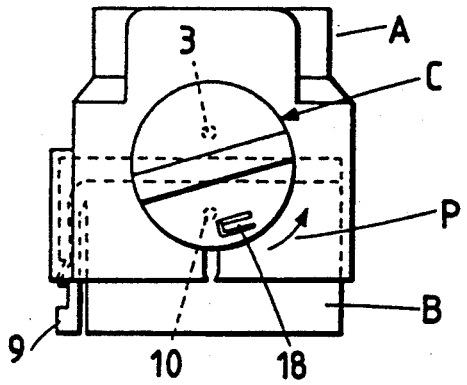
Figure 7C:
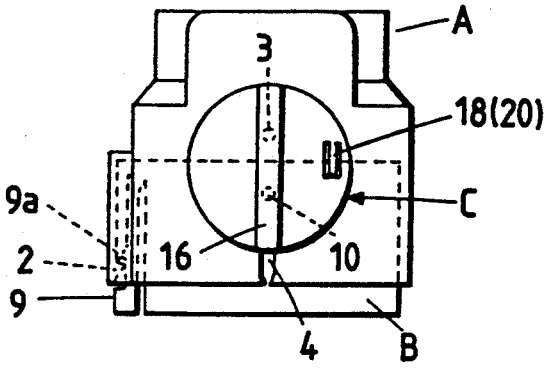

FIGS. 7(A) to 7(C) are plan views showing the process of the fitting of the female and male housings A and B. FIG. 7(A) shows the initial fitting condition, and FIG. 7(B) shows the intermediate fitting condition in which the cam member C is turned 45 degrees in the direction of arrow P, and FIG. 7(C) shows the completely-fitted condition in which a projection **9*a* of the lock arm 9 of the male housing B is engaged with the retaining portion 2 of the female housing A to thereby lock the two housings relative to each other. In this completely-fitted condition, the upwardly-flexed flexible lock member 18 reaches the complete lock hole 20 (see FIG. 1**) to be returned, so that the cam member C is locked against angular movement. When the female and male housings A and B are to be disengaged from each other, the above procedure is reversed.

When the female and male housings A and B are to be fitted together, the two housings are moved in their fitting directions by the angular movement of the cam member C, and at this time the fitting is achieved with a small force due to the engagement of the cam follower pins 10 and 3 in the cam grooves 15 and 15', and therefore the operation can be carried out quite smoothly. At the intermediate fitting stage, the thumbpiece 16 of the cam member C is inclined relative to the edges of the female and male housings A and B, and the flexible lock member 18 is projected from the opening 17 beyond the upper surface of the rotation plate 12, and therefore an incomplete fitting can be prevented.

FIGS. 8 to 11 show the second embodiment of the invention. A thumbpiece 16' of a cam member $C_1$ is withdrawably mounted on a rotation plate 12, and the thumbpiece 16' can be locked when female and male housings A and B are completely fitted together.

Figure 8:
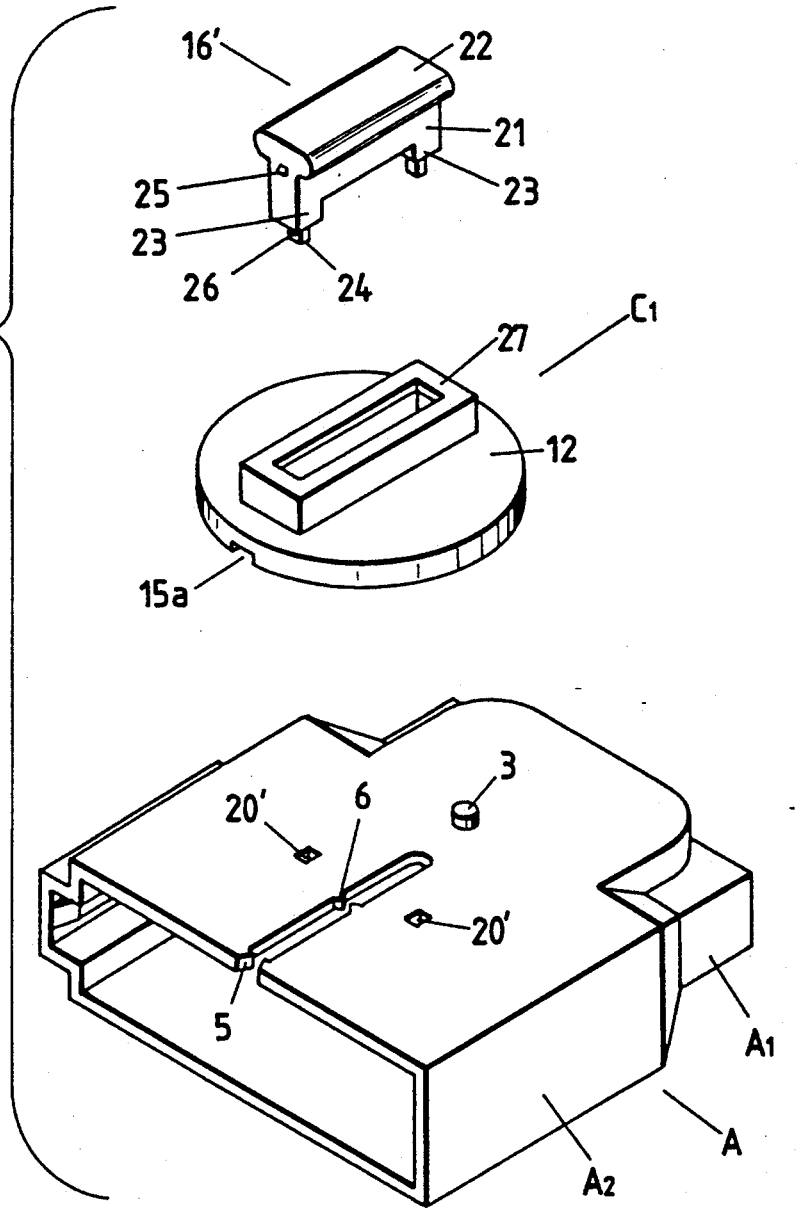
FIG. 8 is a perspective view of a second embodiment of the invention, showing a female housing and a cam member as being separated from each other.
Figure 9:
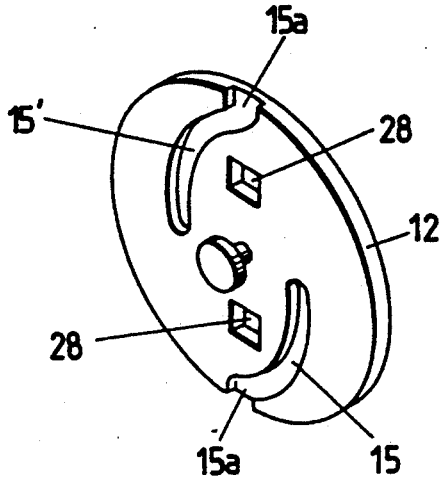
FIG. 9 is a perspective view showing a lower side of a rotation plate in FIG. 8.

As shown in FIG. 8, the thumbpiece 16' has a head 22 formed on a body 21, and has legs 23 formed respectively on opposite sides of a lower surface thereof, and a complete lock piece 24 is projected from each leg 23. Provisional lock pawls 25 are formed respectively on the opposite end surfaces of the body 21, and a complete lock pawl 26 is formed on each lock piece 24.

A thumbpiece holder 27 is formed on an outer surface of the rotation plate 12 at a central portion thereof, and is disposed parallel to a line interconnecting introduction grooves **15*a* and 15*a* (see FIG. 1) of cam grooves 15 and 15' provided respectively on the opposite sides of the thumbpiece holder. Within the holder 27, a pair of holes 28 (see FIG. 9) for respectively passing the legs 23 therethrough are formed through the rotation plate, and a rotation shaft 13 is disposed centrally of the distance between the two holes 28. There are provided a pair of lock holes 20' for the lock pieces 24 of the thumbpiece 16'** of the cam member $C_1$.

Figure 10A:
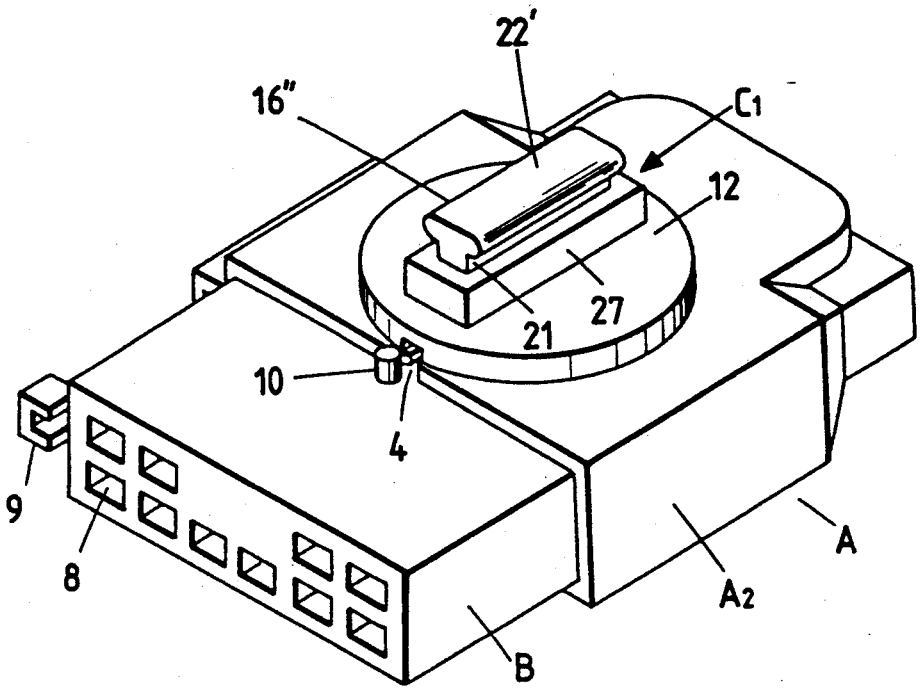
FIGS. 10(A) and 10(B) are perspective views, showing an initial fitting condition and a completely-fitted condition of the female and male housings, respectively, by the use of the cam member of FIG. 8.
Figure 11A:
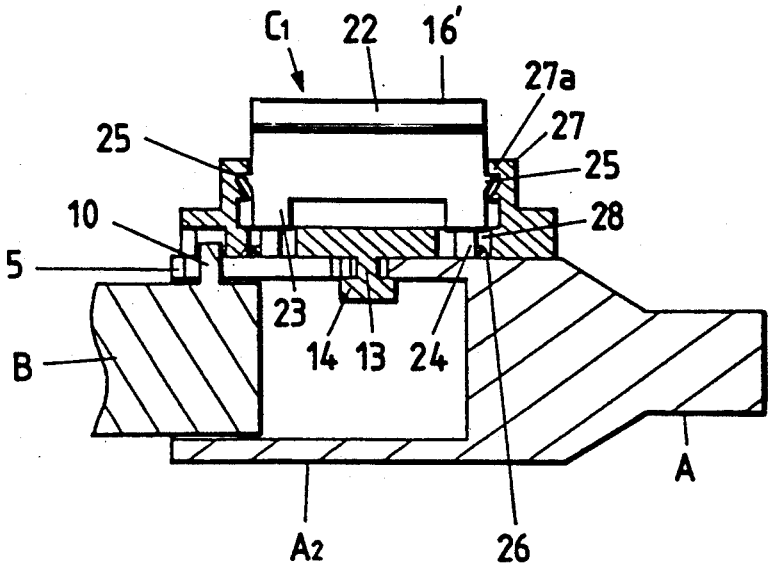
FIGS. 11(A) and 11(B) are cross-sectional views showing the operation of an angular movement-effecting thumbpiece in FIG. 8.

As in the first embodiment, the rotation shaft 13 of the cam member $C_1$ is inserted into a pin guide groove 4 to achieve a provisionally-retained condition. In this condition, when the thumbpiece 16' is inserted into the holder 27, one of the pair of lock pieces 24 is abutted against an outer surface of a hood $A_2$ of the female housing A, and at the same time the provisional lock pawls 25 and 25 are engaged respectively with retaining portions **27*a* of the holder 27, so that the thumbpiece is provisionally locked, as shown in FIGS. 10(A) and 11(A). Namely, the cam member $C_1$ can easily be angularly moved in a direction of arrow P by grasping the head 22 of the thumbpiece 16'**.

FIG. 10(A) shows a condition in which the male housing B begins to be fitted in the hood $A_2$ in the provisionally-locked condition of the cam member $C_1$ and the thumbpiece 16'. FIG. 11(A) shows a condition in which a cam follower pin 10 of the male housing 10 passes past provisionally-retaining pins 5, and reaches the inlet of the cam groove 15.

Figure 10B:
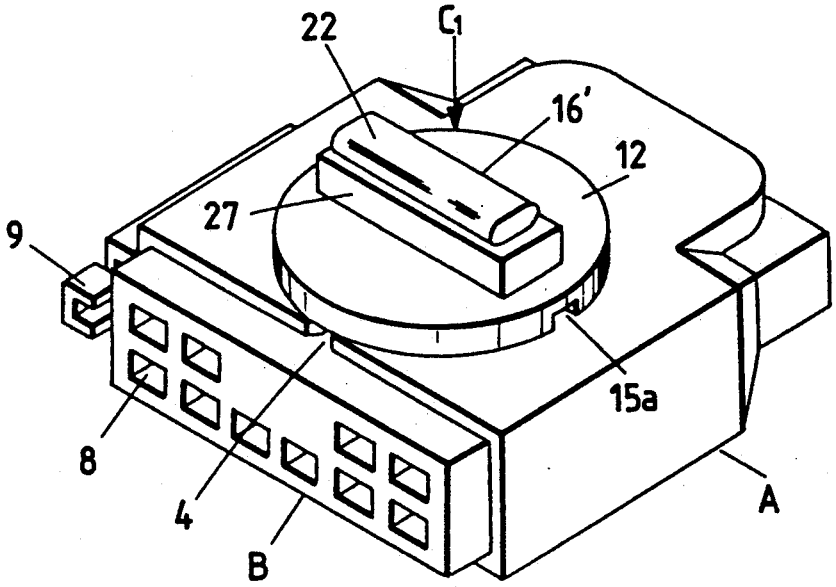
Figure 11B:
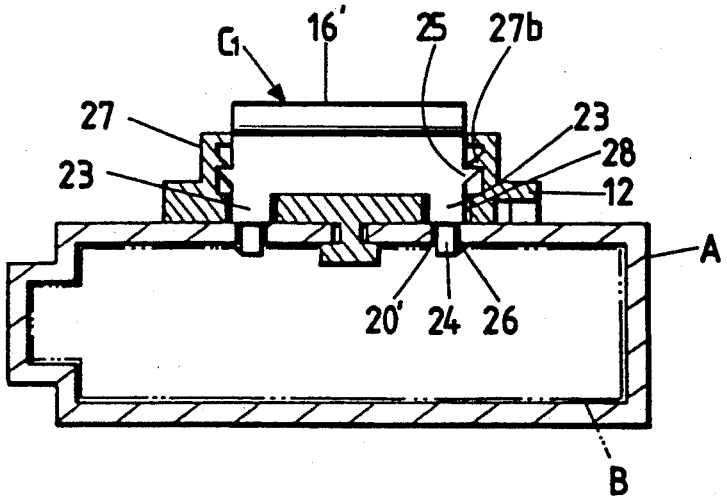

FIGS. 10(B) and 11(B) show a completely-fitted condition of the female and male housings A and B achieved by the angular movement of the cam member $C_1$. In this condition, when the head 22 of the thumbpiece 16' is pressed down, the two legs 23 are passed respectively through the holes 28 of the rotation plate 12, and the lock pieces 24 are inserted respectively into the complete lock holes 20' of the female housing A, and the complete lock pawls 26 are engaged respectively with the edges of these holes, and the provisional lock pawls 25 are engaged respectively with retaining portions **27*b* in the holder 27, so that the thumbpiece is locked. Namely, the thumbpiece 16'** is locked only when the female and male housings A and B are completely fitted together.

Figure 12:
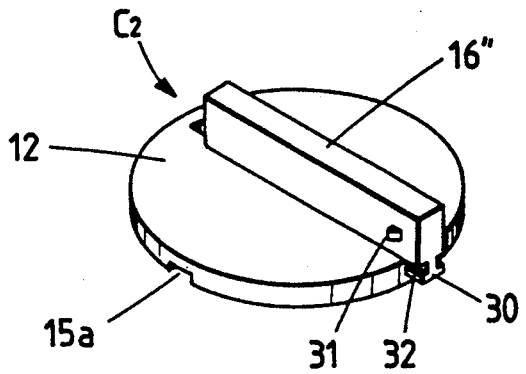
FIG. 12 is a perspective view showing a modified cam member of the second embodiment in a separate condition.
Figure 12:
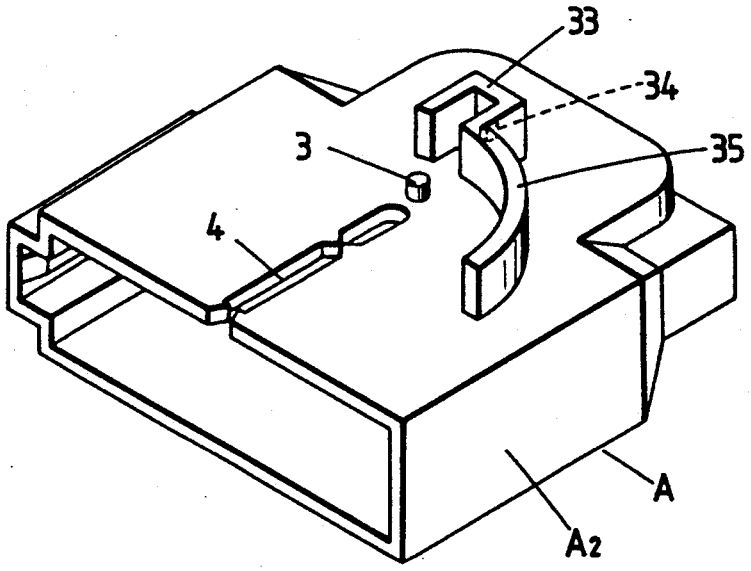

FIGS. 12 and 13 show a modification of the second embodiment. In this embodiment, an elongate projection 30 of a T-shaped cross-section is formed on a lower end of a thumbpiece 16" of a cam member $C_2$, and is slidably inserted in an insertion groove 32 formed in an outer surface of a rotation plate 12. One end of the insertion groove 32 is open to the outer peripheral edge of the rotation plate 12, and the other end thereof is closed. The thumbpiece 16" as well as the insertion groove 32 is slightly smaller than the diameter of the rotation plate 12, and is disposed perpendicular to a line interconnecting introduction grooves 15*a* and 15*a* disposed respectively on opposite sides thereof. A complete lock projection 31 is formed on the side surface of the thumbpiece 16" at one end portion thereof.

On the other hand, a lock wall 33 for the thumbpiece 16", as well as a half-fitting prevention guide wall 35 are formed on a hood $A_2$ of a female housing A, and is disposed rearwardly of a pin guide groove 4 and a cam follower pin 3. The lock wall 33 has a U-shape, and can fit on one end of the thumbpiece 16", and a recess 34 for engagement with the projection 31 is formed in an inner surface of the lock wall.

Figure 13A:
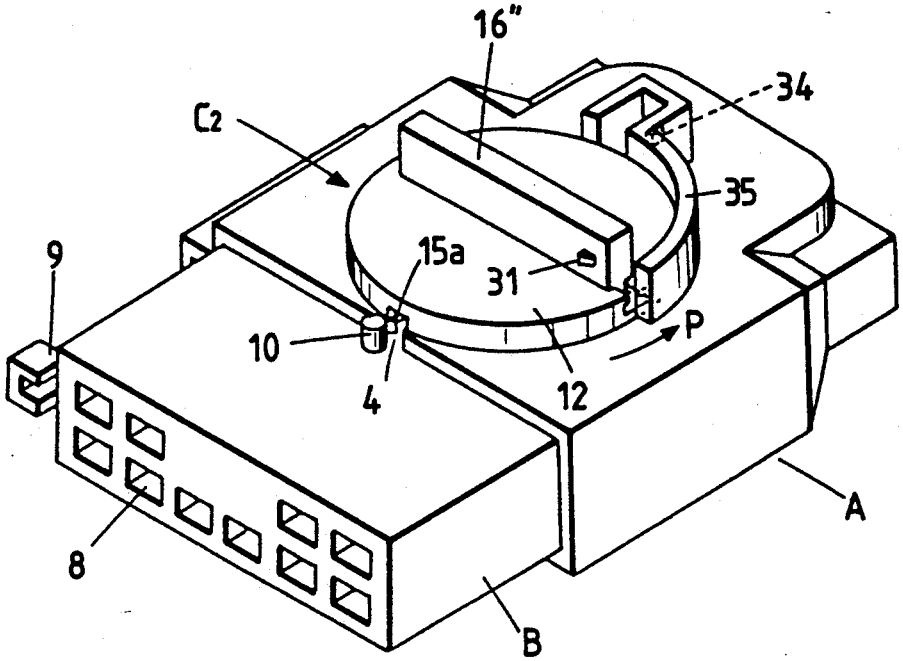
FIGS. 13(A) and 13(B) are perspective views, showing an initial fitting condition and a completely-fitted condition of female and male housings, respectively, by the use of a thumbpiece in FIG. 12.

As shown in FIG. 13(A), in the condition in which the cam member $C_2$ is provisionally retained on the female housing A, one end of the thumbpiece 16" is generally in registry with the end of the guide wall 35, and the introduction groove 15*a* (of the cam groove 15) of the rotation plate 12 is disposed in registry with the pin guide groove 4 of the female housing A. Then, in a manner as described above, a cam follower pin 10 of a male housing B is pushed into the cam groove 15 via the introduction groove 15*a*, and the cam member $C_2$ is angularly moved in the direction of arrow P until the two housings A and B are completely fitted together.

Figure 13B:
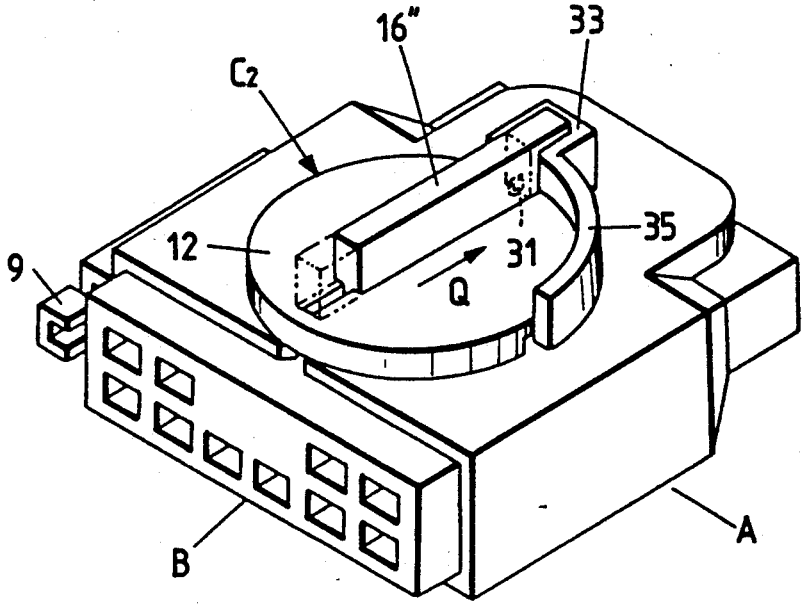
Figure 14:
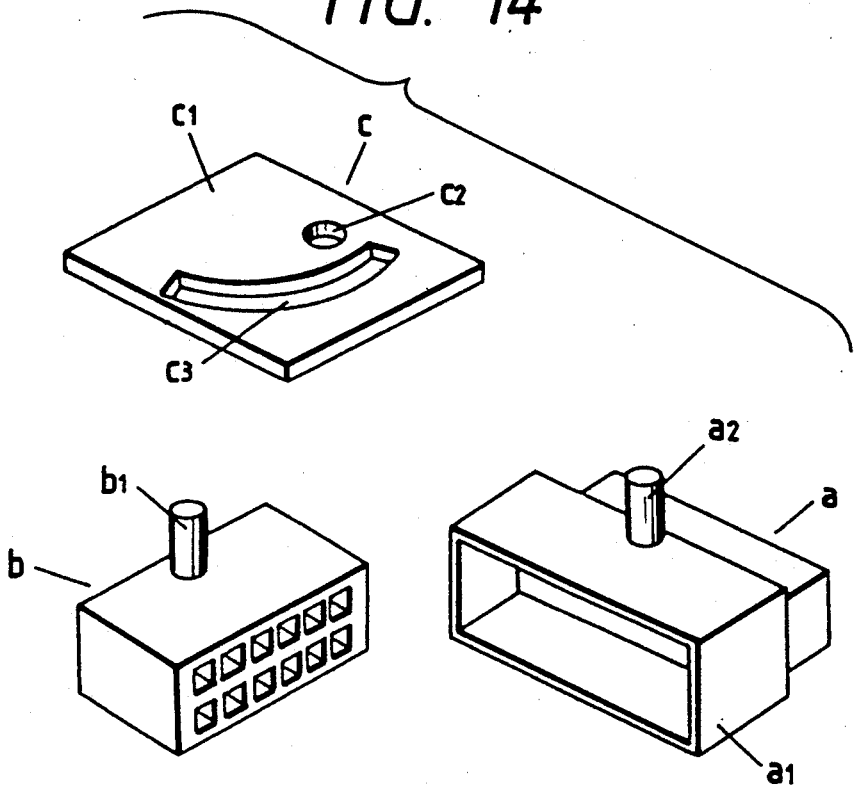
FIG. 14 is a perspective view of a conventional low insertion/withdrawal-force connector in a separate condition.
Figure 15:
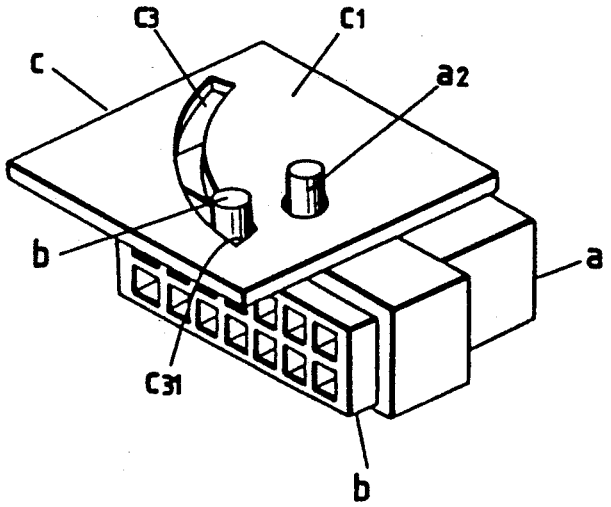
FIG. 15 is a perspective view of the connector of FIG. 14 in an assembled condition.

FIG. 13(B) shows the condition in which the female and male housings A and B are completely fitted together, and the thumbpiece 16" is completely locked. Namely, the thumbpiece 16" is slidingly moved in a direction of arrow Q, so that one end thereof is engaged in the lock wall 33, and the projection 31 is engaged in the recess 34 to lock the thumbpiece. It is clear that the thumbpiece 16" is not locked at the stage between the start and the end of the fitting operation.

As described above, in the present invention, before the pair of housings are completely fitted together, the cam member (the rotation plate or the angular movement-effecting thumbpiece) can not be locked, and therefore there can be provided the low insertion/withdrawal-force connector which prevents an incomplete fitting, thus ensuring the complete fitting, and is highly reliable in electrical connection. Unlike the conventional construction, the pair of housings are moved toward each other in the fitting direction, and therefore the fitting operation and the disengagement operation can be easily effected, and this construction is suited for a multi-pole connector, and the number of operation steps is reduced because the cam member does not need to be removed.

What is claimed is:

1. A low insertion/withdrawal-force connector comprising:

a cam member including a rotation plate, a rotation shaft extending from a lower surface of said rotation plate, and a pair of cam grooves provided in said lower surface of said rotation plate, said cam grooves being continuous respectively with introduction grooves and disposed symmetrically with respect to said rotation shaft;

a male housing having a first cam follower pin;

a female housing in which said male housing is movably fitted, said female housing having a second cam follower pin and a pin guide groove for receiving said first cam follower pin and said rotation shaft; and means for locking said male housing and said female housing when said male housing is completely fitted in said female housing, wherein when said cam member is angularly moved in an initial fitting condition of said male and female housing in which said first and second cam follower pins are respectively engaged in said pair of cam grooves, said cam member and said male housing move toward an inner end of said pin guide groove, and, attendantly said male and female housings are moved toward each other.

2. A low insertion/withdrawal-force connector according to claim 1, wherein said locking means includes:

a lock member provided in said introduction groove of one of said cam grooves, said lock member having a lock piece and a lock release projection; and a lock hole provided in said female housing, wherein said first cam follower pin is engaged with said lock release projection to release the engagement between said lock member and said female housing at the time of the initial fitting of said male and female housings, thereby allowing the angular movement of said cam member, and said lock piece is engaged in said lock hole at the time of the complete fitting of said male and female housings.

3. A low insertion/withdrawal-force connector according to claim 1, wherein said cam member further includes a rotation shaft retaining plate provided at a distal end of said rotation shaft.

4. A low insertion/withdrawal-force connector according to claim 1, further comprising a thumbpiece provided on an upper surface of said rotation plate.

5. A low insertion/withdrawal-force connector according to claim 4, wherein said locking means includes:

a pair of lock pieces projecting from said thumbpiece; and a pair of lock holes provided in said female housing, wherein said thumbpiece is disposed in a first position at the time of the initial fittings of said male and female housing, thereby allowing the angular movement of said cam member, and said thumbpiece is pushed down in a second position in such a manner that said pair of lock pieces are engaged in said pair of lock holes at the time of the complete fitting of said male and female housing.

6. A low insertion/withdrawal-force connector according to claim 4, further comprising a U-shaped lock wall and a half-fitting prevention guide wall which are provided on said female housing, wherein said thumbpiece is slidably provided to said rotation plate and said thumbpiece is slidingly movable so as to be engaged in said U-shaped lock wall when said male housing is completely fitted in said female housing.

7. A low insertion/withdrawal-force connector comprising:

a cam member including cam grooves which are continuous respectively with introduction grooves, are provided at a lower surface of a rotation plate, and are disposed symmetrically with respect to a rotation shaft;

a pair of housing which are fittable together and disengageable from each other by angularly moving said cam member, said pair of housing having cam follower pins, respectively, which are engaged in said cam grooves of said cam member, respectively, one of said housings having a pin guide groove which guides said cam follower pin of the other housing and said rotation shaft of said cam member, wherein when said cam member is angularly moved in an initial fitting condition of said pair of housings in which said cam follower pins of said housings are engaged respectively in said pair of cam grooves, said cam member and the other housing move toward an inner end of said pin guide groove, and, attendantly said pair of housings are moved toward each other; and a flexible lock member, having a lock release projection, provided in said introduction groove of one of said cam grooves in said rotation plate, wherein said cam follower pin of the other housing is engaged with said lock release projection to release the engagement between said flexible lock member and said one housing at the time of the initial fitting of said pair of housings, thereby allowing the angular movement of said cam member.

8. A low insertion/withdrawal-force connector according to claim 7, wherein said cam member further includes a rotation shaft retaining plate provided at a distal end of said rotation shaft.

9. A low insertion/withdrawal-force connector comprising:

a cam member including cam grooves which are continuous respectively with introduction grooves, are provided at a lower surface of a rotation plate, and are disposed symmetrically with respect to a rotation shaft;

a pair of housings which are fittable and disengageable from each other by angularly moving said cam member, said pair of housings having cam follower pins, respectively, which are engaged in said cam grooves of said cam member, respectively, one of said housings having a pin guide groove which guides said cam follower pin of the other housing and said rotation shaft of said cam member, wherein when said cam member is angularly moved in an initial fitting condition of said pair of housings in which said cam follower pins of said housings are engaged respectively in said pair of cam grooves, said cam member and the other housing move toward an inner end of said pin guide groove, and, attendantly, said pair of housings are moved toward each other;

an angularly movement-effecting thumbpiece movably mounted on an upper surface of said rotation plate; and lock means provided between said one housing and said thumbpiece so as to lock said thumbpiece when said pair of housings are completely fitted together.

10. A low insertion/withdrawal-force connector according to claim 9, wherein said cam member further includes a rotation shaft retaining plate provided at a distal end of said rotation shaft.

11. A low insertion/withdrawal-force connector according to claim 9, wherein said thumbpiece is detachably mounted on said upper surface of said rotation plate.

12. A low insertion/withdrawal-force connector according to claim 9, wherein said thumbpiece is slidably mounted on said upper surface of said rotation plate.

* * * * *